US006872124B2

(12) United States Patent
Matsuzaki et al.

(10) Patent No.: US 6,872,124 B2
(45) Date of Patent: Mar. 29, 2005

(54) SUPERFINISHING APPARATUS

(75) Inventors: Kazumi Matsuzaki, Kanagawa (JP); Etsuo Kanakubo, Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 10/729,913

(22) Filed: Dec. 9, 2003

(65) Prior Publication Data

US 2004/0121705 A1 Jun. 24, 2004

(30) Foreign Application Priority Data

Dec. 19, 2002 (JP) ..... P. 2002-368486
Nov. 19, 2003 (JP) ..... P. 2003-389281

(51) Int. Cl.[7] ..... B24B 49/00
(52) U.S. Cl. ..... 451/13; 451/165; 451/DIG. 910
(58) Field of Search ..... 451/13, 52, 164, 451/165, DIG. 910

(56) References Cited

U.S. PATENT DOCUMENTS 3,457,680 A * 7/1969 Gisaburo ..... 451/164
4,222,203 A 9/1980 Wolff et al.
4,963,164 A * 10/1990 Weber ..... 451/5

FOREIGN PATENT DOCUMENTS

JP 51-12157 4/1976
JP 3-11556 2/1991

* cited by examiner

*Primary Examiner*—M. Rachuba
(74) *Attorney, Agent, or Firm*—Sughrue Mion, PLLC

(57) ABSTRACT

The superfinishing apparatus according to the present invention includes a frame 51 for holding the entirety of the apparatus, a cam shaft 52 attached to the frame 51 so as to rotate freely, first and second eccentric cams 53, 54 which are attached to the cam shaft 52 and rotate with a phase difference of 180 degrees therebetween, a first vibrator 55 having a polygonal shape in its section which moves in a sliding manner in accordance with the rotation of the first eccentric cam 53, a second vibrator 57 having a polygonal shape in its section which is disposed so as to oppose to the first vibrator 55 through the cam shaft 52 and moves in a sliding manner in accordance with the rotation of the second eccentric cam 54, air bearings 59, 60 for supporting the first vibrator 55 and the second vibrator 57, and a superfinishing stone 61 attached to the first vibrator 55 or the second vibrator 57.

5 Claims, 5 Drawing Sheets

SUPERFINISHING APPARATUS

BACKGROUND OF THE INVENTION

The present invention relates to a superfinishing apparatus and, in particular, relates to a superfinishing apparatus suitable for superfinishing the inner and outer rings of roller bearing.

Conventionally, as an apparatus for superfinishing the inner ring of a tapered roller bearing, a superfinishing stone head vibration apparatus of a superfinishing machine equipped with a vibration mechanism is proposed as shown in FIG. 4 (see the patent document 1, for example).

The superfinishing stone head vibration apparatus of the superfinishing machine is arranged in a manner that right and left vibrators 3, 3 for supporting a superfinishing stone 11 is suspended by a pair of round bar guides 2, 2 through hair bearings 4, 4, respectively. A cam shaft 5 is disposed between the right and left vibrators 3, 3.

As shown in FIG. 5, the cam shaft 5 is provided with vibration rings 15, 15 having a pair of eccentric cams 6, 6 which are made eccentric equally in the opposite directions to each other. As shown in FIG. 4, the vibration rings 15, 15 are held in a manner that they are sandwiched so as to reciprocally move freely by springs 7, 7 which press the right and left vibrators 3, 3 towards the eccentric cams 6, 6, respectively.

Incidentally, in FIGS. 4 and 5, a reference numeral 1 depicts a frame, 8 an adjusting screw, 9 an engagement portion, 10 a superfinishing stone head, 12 a rod, 13 a cylinder, 14 an operation button, 16 a tapered shaft portion and 17 a bolt.

This superfinishing stone head vibration apparatus makes it possible to vibrate at a high speed without causing any friction thereby to improve the durability of the machine, and further can easily obtain uniform and fine surface roughness and correct roundness.

Further, apparatus for finishing a rib and a raceway of an inner ring of a tapered roller bearing is proposed. (see the patent document 2, for example) According to the apparatus, the raceway pressurizes a conventionally known horn-type superfinishing stone, and traverses the superfinishing stone along a groove of the raceway with applying minute vibration to finish the groove.

On the contrary, a rotating conical trapezoidal grinding wheel is used for a rib to make a desired spherical form. Namely, since the process of a rib makes a form, the process is similar to grinding, and it is difficult to improve roughness of the rib. Further, by rotating the grinding wheel, a spindle mechanism is needed, and the apparatus becomes complicated.

Further, an apparatus for simultaneously processing a rib and a raceway of an inner ring of a tapered roller bearing is proposed. (see the patent document 3, for example) The apparatus is characterized in that the inner ring of a tapered roller bearing is applied and exhausted with being in a horizontal status. Due to being in the horizontal status, the inner ring does not fall down, and miss-loading is hardly caused.

However, a size of the apparatus becomes large due to simultaneous process of a raceway and a rib, and an operationality becomes worse.

[Patent Document 1]

Examined Japanese Patent Application Publication No. Sho51-12157

[Patent Document 2]

U.S. Pat. No. 4,222,203 (Unexamined Japanese Patent Application Publication No. Sho54-15594)

[Patent Document 3]

Japanese Utility Model Application Publication No. Hei3-11556

However, recently, according to a high accuracy of a tapered roller bearing, superfinishing process is adopted in order to improve roughness of a rib. Further, apparatuses for simultaneously processing a raceway and a rib of an inner ring of a tapered roller bearing are developed.

According to such apparatuses, if conventional superfinishing stone head vibration apparatus are mounted on a raceway and a rib thereof, the apparatuses grow in size and cost becomes high.

Furthermore, when the size of the apparatus becomes large, a distance between the front surface side to the processing portion of the apparatus becomes long, so that such a problem in use occurs that the exchange of the superfinishing stone 11 and the exchange of a jig tool becomes difficult.

SUMMARY OF THE INVENTION

The invention is made in view of the aforesaid problems and an object of the invention is to provide a superfinishing apparatus which can make an oscillation mechanism compact and hence can make the apparatus miniaturize.

The invention is characterized by including: a frame for holding the entirety of the apparatus; a cam shaft attached to the frame so as to rotate freely; first and second eccentric cams which are attached to the cam shaft and rotate with a phase difference of 180 degrees therebetween; a first vibrator having a polygonal shape in its section which moves in a sliding manner in accordance with the rotation of the first eccentric cam; a second vibrator having a polygonal shape in its section which is disposed so as to oppose to the first vibrator through the cam shaft and moves in a sliding manner in accordance with the rotation of the second eccentric cam; air bearings for supporting the first vibrator and the second vibrator; and a superfinishing stone attached to the first vibrator or the second vibrator.

Further, the present invention is characterized in that the first and the second vibrators have quadrangle cross-section.

Still further, the present invention is characterized in that the first and the second vibrators are static pressure slides.

Still further, the present invention is characterized in that the second vibrator is attached to an inside of the first vibrator. In this case, the entire length of the first and the second vibrators can be made short, and a miniaturizing is realized.

Moreover, a superfinishing apparatus according to the present invention is characterized in that a super abrasive superfinishing stone is used as the superfinishing stone. The super abrasive superfinishing stone may be CBN, diamond etc. for example. Since the CBN, diamond grain are harder and have less amount of wear than aluminum grain, the length of the superfinishing stone can be made short. Then, a slide for pressing the superfinishing stone can also be made short, and a more miniaturizing can be realized.

Still further, a superfinishing apparatus according to the present invention is characterized in being provided on a superfinishing apparatus in which a rib and a raceway of an inner ring of a tapered roller bearing are subject to a simultaneous superfinishing.

DETAILED DESCRIPTION OF THE PREFERRED EMBODIMENTS

Hereinafter, an embodiment of the superfinishing apparatus according to the invention will be explained in detail with reference to the accompanying drawings.

Figure 1:
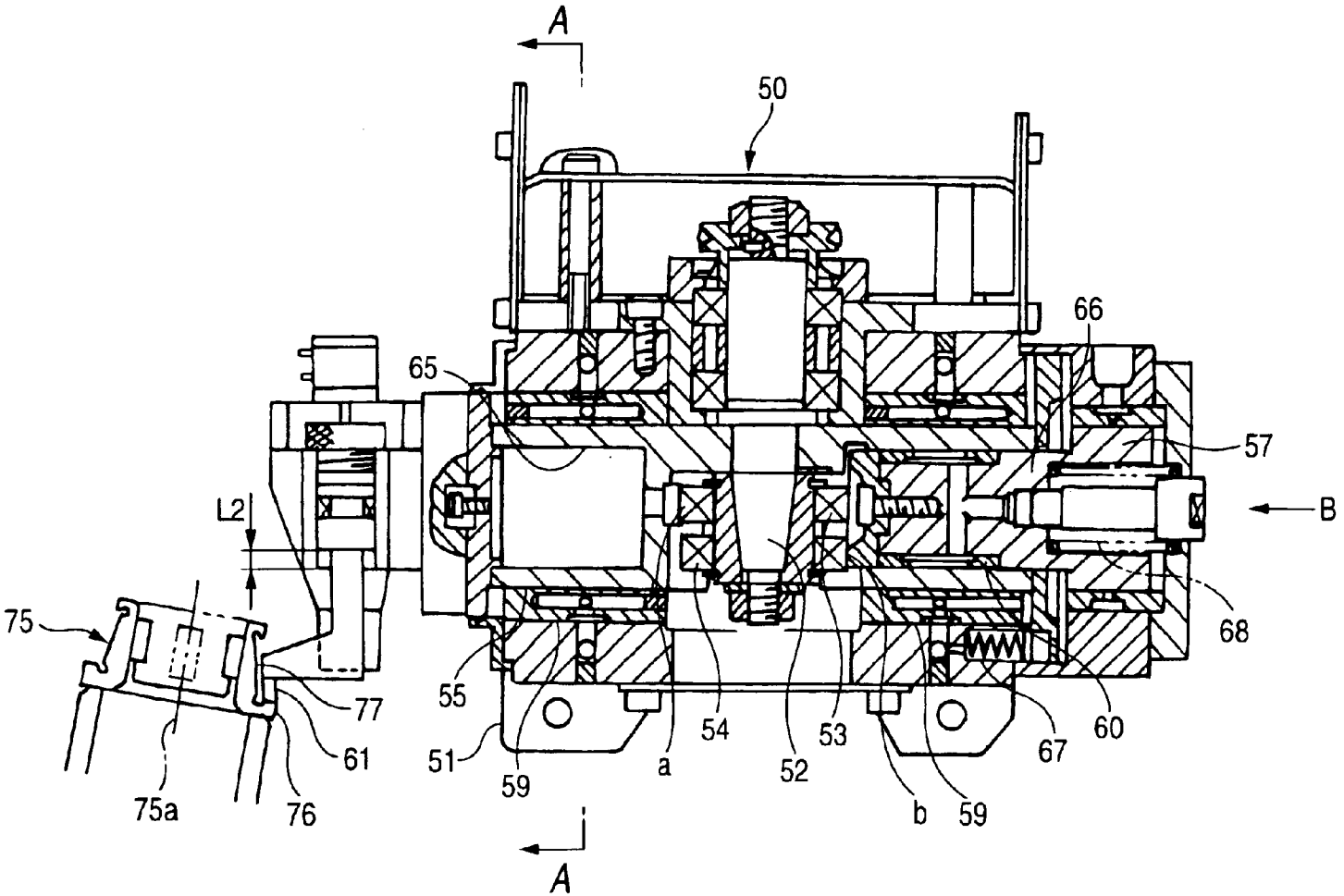
FIG. 1 is a sectional diagram showing the superfinishing apparatus according to the invention.

FIG. 1 shows a superfinishing apparatus 50 according to the invention. The superfinishing apparatus 50 is provided with a frame 51 for holding the entirety of the apparatus, a cam shaft 52 attached to the frame 51 so as to rotate freely, and first and second eccentric cams 53, 54 which are attached to the cam shaft 52 and rotate with a phase difference of 180 degrees therebetween.

Further, the superfinishing apparatus 50 is provided with a first vibrator 55 having apolygonal shape in its section which moves in a sliding manner in accordance with the rotation of the first eccentric cam 53, and a second vibrator 57 having a polygonal shape in its section which is disposed so as to oppose to the first vibrator 55 through the cam shaft 52 and moves in a sliding manner in accordance with the rotation of the second eccentric cam 54.

Furthermore, the superfinishing apparatus 50 is provided with air bearings 59, 60 for supporting the first vibrator 55 and the second vibrator 57 and also provided with a superfinishing stone 61 attached to the first vibrator 55.

Next, explanation will be made as to each of the aforesaid constituent elements.

Figure 2:
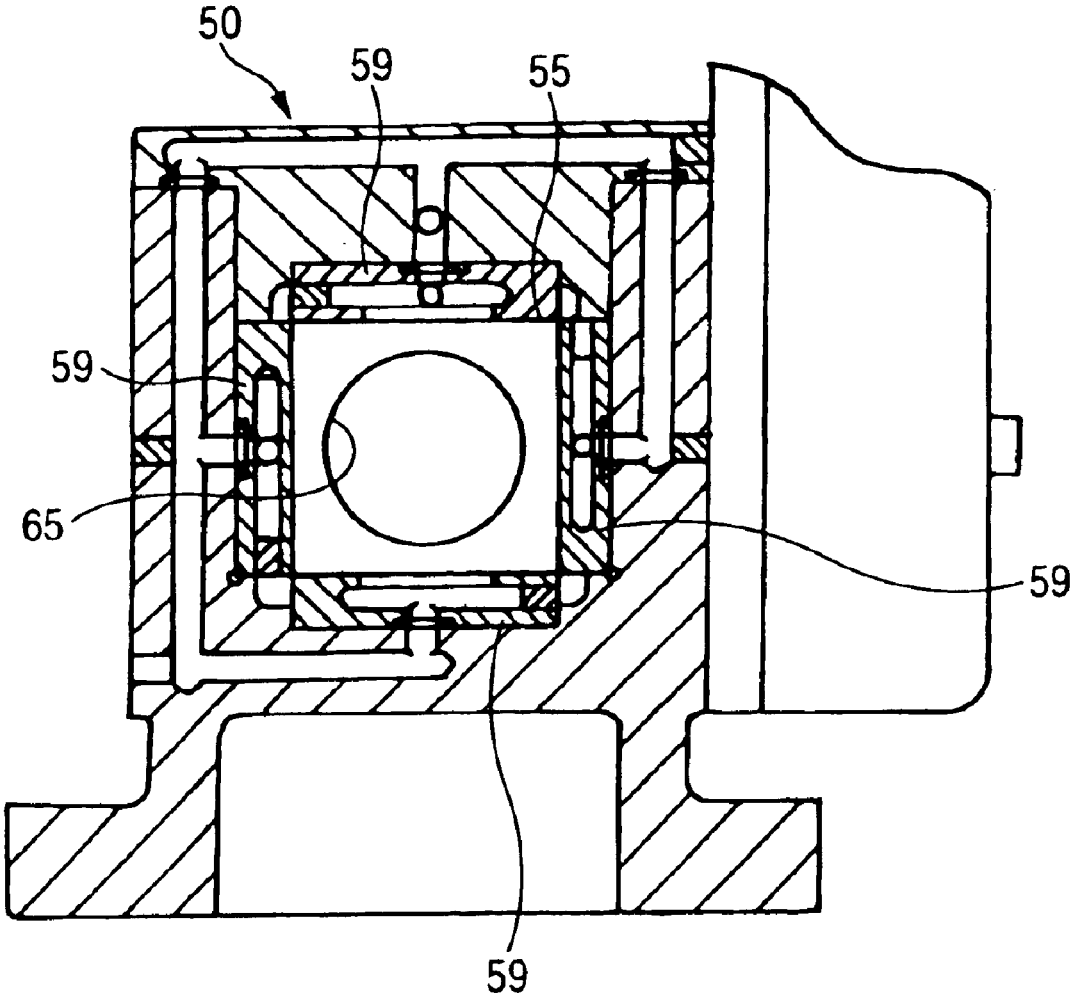
FIG. 2 is a sectional diagram along a line A—A in FIG. 1.

As shown in FIG. 2, the first vibrator 55 is formed to have a quadrangle shape in its section and is provided at the inside thereof with a cavity 65 having a circular sectional shape which extends over a predetermined length from the end surface thereof. The first vibrator 55 is supported at its four outer peripheral planes by the air bearings 59, respectively. The air bearings 59 may be plate-shaped, for example.

Further, as shown in FIG. 1, the first vibrator 55 extends in the both sides of the cam shaft 52. The cam shaft 52 extends so as to penetrate almost the center portion of the first vibrator 55. Furthermore, the second vibrator 57 is inserted so as to slide freely into a hole 66 having a quadrangle sectional shape which is formed at a side of the first vibrator 55 opposing to the cavity 65.

The second vibrator 57 is supported at its four outer peripheral planes by the air bearings 60, respectively. The air bearings 60 may be plate-shaped, for example.

The first vibrator 55 is biased to the second vibrator 57 side by a spring 67 and so abuts against the cam surface a of the first eccentric cam 53. The second vibrator 57 is biased to the cam shaft 52 side by a spring 68 and so abuts against the cam surface b of the second eccentric cam 54.

Super abrasive superfinishing stone is used as the superfinishing stone 61. The super abrasive superfinishing stone may be CBN, diamond etc. for example.

Figure 3:
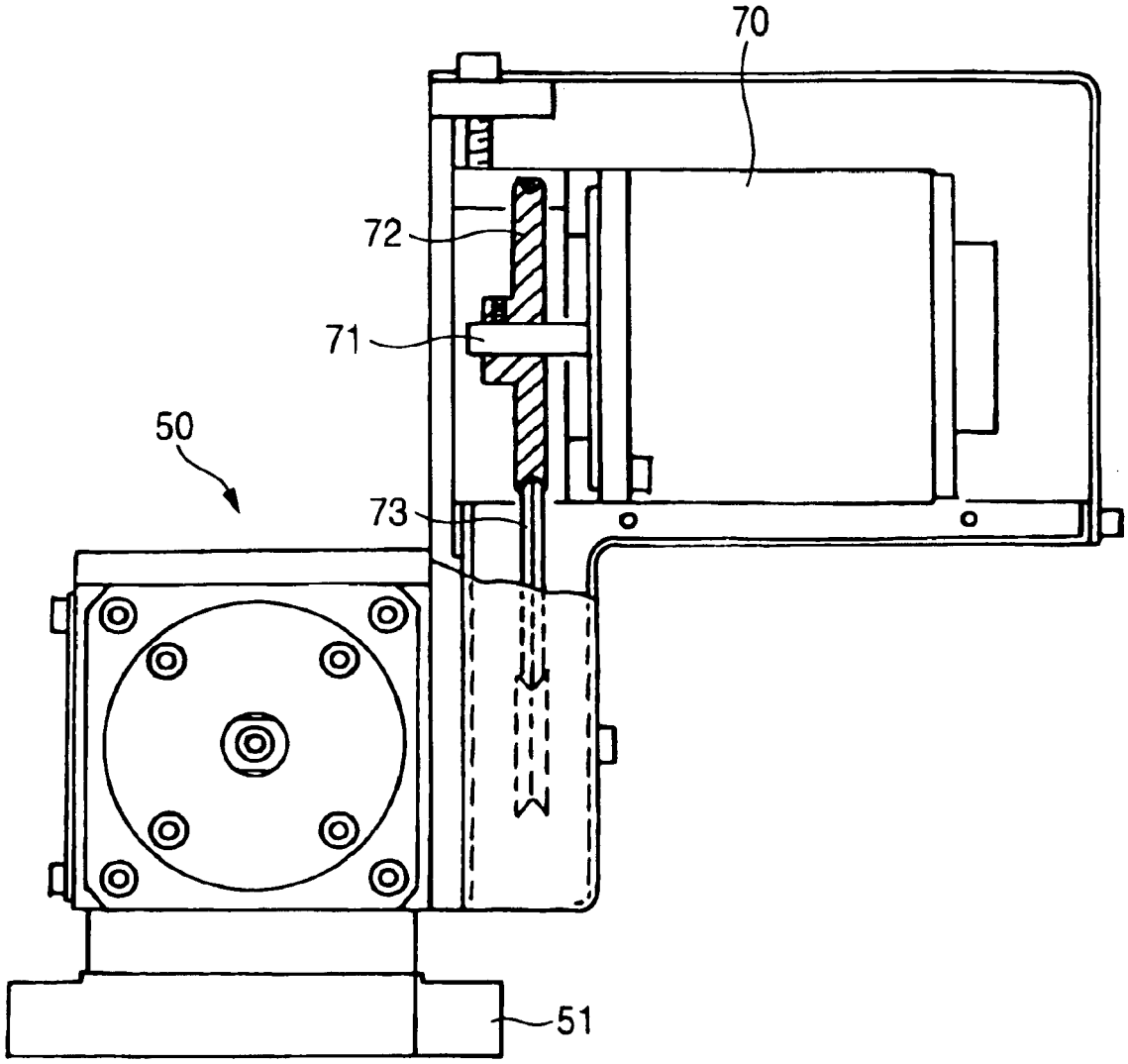
FIG. 3 is a diagram seen from an arrow B in FIG. 1.
Figure 4:
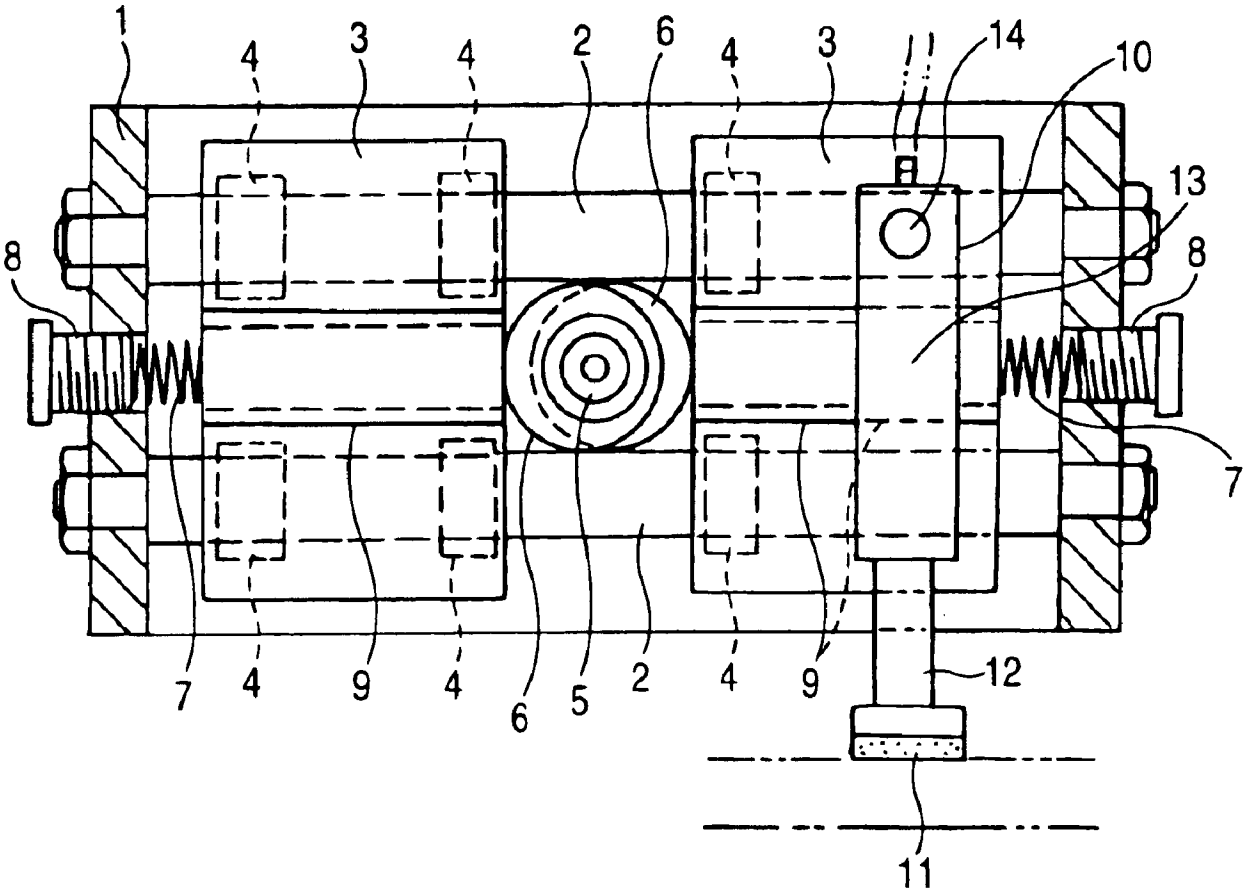
FIG. 4 is a diagram showing an example of the conventional superfinishing apparatus.
Figure 5:
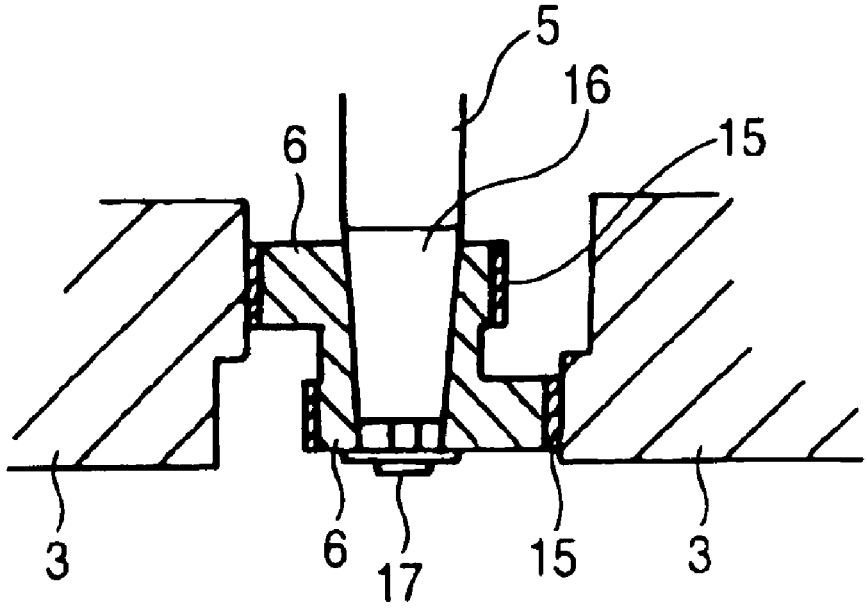
FIG. 5 is a diagram showing an example of the conventional eccentric cam.

As shown in FIG. 3, the superfinishing apparatus 50 has a motor 70 for driving the cam shaft 52. The rotation shaft 71 of the motor 70 is coupled to the cam shaft 52 through a pulley 72 and a V belt 73.

Next, the action of the superfinishing apparatus 50 will be explained.

As shown in FIG. 1, in the case of superfinishing the rib portion 76 of the inner ring 75 of the tapered roller bearing, the inner ring 75 is rotated around a center shaft 75*a* thereof. Then, the superfinishing stone 6l of the superfinishing apparatus 50 is urged against the rib portion 76 of the inner ring 75.

In this state, the cam shaft 52 is rotated. Thus, both the first eccentric cam 53 and the second eccentric cam 54 rotate, and so the first vibrator 55 and the second vibrator 57 move in a sliding manner (vibrate) in opposite directions to each other in accordance with the rotation of these cams.

Further, the superfinishing stone 61 attached to the first vibrator 55 vibrates along the finishing surface of the rib portion 76 thereby to perform the superfinishing.

In this manner, the superfinishing apparatus 50 according to the invention is arranged in a manner that the first vibrator 55 and the second vibrator 57 each having the polygonal sectional shape, that is, the quadrangle sectional shape in this embodiment vibrate in the opposite direction to each other. Thus, the entire balance of the superfinishing apparatus 50 is kept and so the apparatus can be operated stably, and further a mechanism for stopping the rotation of the first vibrator 55 and the second vibrator 57 can be eliminated.

Accordingly, the size of the oscillation mechanism including the first and second vibrators 55, 57 can be made compact, the entire size of the superfinishing apparatus 50 can be made small and the cost of the apparatus can be reduced.

Further, since the second vibrator 57 is disposed within the first vibrator 55, the entire length of each of the oscillation mechanism and the superfinishing apparatus 50 can be made shorter. Since the size of the superfinishing apparatus 50 can be made small in this manner, the distance between the front surface of the superfinishing apparatus 50 and the superfinishing stone 61 becomes short, whereby the operability can be improved in such a case of exchanging the superfinishing stone 61.

Incidentally, in the aforesaid embodiment, although the explanation is made as to the case where the rib portion 76 of the inner ring 75 of the tapered roller bearing is subjected to the superfinishing, the present invention can also be applied to the case where both the rib portion 76 and the raceway 77 of the inner ring 75 are simultaneously subjected to the superfinishing.

In this case, although a superfinishing apparatus (not shown) for superfinishing the raceway 77 having almost the same configuration as that of the superfinishing apparatus 50 is required in addition to the superfinishing apparatus 50 for superfinishing the rib portion 76, since these superfinishing apparatuses can be made small as described above, the entire configuration of the apparatuses can also be made small.

Thus, the occupied area and also the cost of the apparatus can be reduced.

Furthermore, since the super abrasive superfinishing stone is used as the superfinishing stone 61, the length of the superfinishing stone 61 can be made short, and so a slide for pressing the superfinishing stone 61 can also be made short. Thus, the holder of the superfinishing stone 61 can be made compact and light-weighted.

Further, due to the compacting of the oscillation mechanism and the holder of the superfinishing stone 61, the superfinishing stone 61 can be oscillated at a high speed and so the processing time can be made short.

Although in the aforesaid embodiment, the superfinishing stone 61 is attached to the first vibrator 55, the superfinishing stone 61 may be attached to the second vibrator 57 instead of the first vibrator.

Further, the invention can be applied to the superfinishing apparatus for linearly reciprocating the superfinishing stone 61 in the case of superfinishing the raceway portion, the rib portion and the outer peripheral surface of the rollers etc. of the inner and outer rings of the cylindrical roller bearing as well as the case of superfinishing the rib portion 76 and the raceway 77 of the inner ring 75 of the tapered roller bearing.

As described above, according to the invention, since each of the first and second vibrators constituting the oscillation mechanism is formed to have the polygonal sectional shape, it is not necessary to provide the mechanism for stopping the rotation of the first and second vibrators.

Thus, the apparatus can be miniaturized and the cost of the apparatus can be reduced. Further, since the distance from the front surface to the superfinishing stone side of the apparatus can be made short, the maintenance of the apparatus can be made easy and so the operability thereof is improved.

Further, since the second vibrator is disposed at the inside of the first vibrator, the length including the first and second vibrators can be made short.

Furthermore, since the super abrasive superfinishing stone is used as the superfinishing stone, the length of the superfinishing stone can be made short, and so the slide for pressing the superfinishing stone can also be made short. Thus, the holder of the superfinishing stone can be made compact and light-weighted.

What is claimed is:

1. A superfinishing apparatus comprising:

a frame for holding entirety of the apparatus;

a cam shaft attached to the frame so as to rotate freely;

first and second eccentric cams which are attached to the cam shaft and rotate with a phase difference of 180 degrees therebetween;

a first vibrator having a polygonal shape in its section which moves in a sliding manner in accordance with rotation of the first eccentric cam;

a second vibrator having a polygonal shape in its section which is disposed so as to oppose to the first vibrator through the cam shaft and moves in a sliding manner in accordance with rotation of the second eccentric cam;

air bearings for supporting the first vibrator and the second vibrator; and a superfinishing stone attached to the first vibrator or the second vibrator, wherein the second vibrator is attached to an inside of the first vibrator.

2. The superfinishing apparatus according to claim 1, wherein the first and the second vibrators have quadrangle cross-section.

3. The superfinishing apparatus according to claim 1, wherein the first and the second vibrators are static pressure slides.

4. The superfinishing apparatus according to claim 1, wherein the superfinishing stone is a super abrasive superfinishing stone.

5. A superfinishing apparatus for simultaneously finishing a raceway and a rib of an inner ring of a tapered roller bearing, comprising:

the superfinishing apparatus according to claim 1.

* * * * *